US010101072B2

(12) United States Patent
Akan et al.

(10) Patent No.: US 10,101,072 B2
(45) Date of Patent: Oct. 16, 2018

(54) REFRIGERATOR COMPRISING AN ICE MAKING UNIT

(71) Applicant: ARCELIK ANONIM SIRKETI, Istanbul (TR)

(72) Inventors: Samet Akan, Istanbul (TR); Nihat Gunduz, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 15/327,331

(22) PCT Filed: May 28, 2015

(86) PCT No.: PCT/EP2015/061850

§ 371 (c)(1),
(2) Date: Jan. 18, 2017

(87) PCT Pub. No.: WO2106/015900

PCT Pub. Date: Feb. 4, 2016

(65) Prior Publication Data

US 2017/0198958 A1 Jul. 13, 2017

(30) Foreign Application Priority Data

Aug. 1, 2014 (TR) ..... a 2014/08994

(51) Int. Cl.
*F25C 1/24* (2018.01)
*F25C 5/20* (2018.01)

(52) U.S. Cl.
CPC ..... *F25C 1/24* (2013.01); *F25C 5/22* (2018.01); *F25C 2305/022* (2013.01); *F25C 2500/06* (2013.01)

(58) Field of Classification Search
CPC ..... F25C 5/005; F25C 1/24; F25C 2305/022; F25C 2500/06
See application file for complete search history.

(56) References Cited

U.S. PATENT DOCUMENTS

| | | | | |
|---|---|---|---|---|
| 2,769,316 | A | 11/1956 | Candor | |
| 2010/0037646 | A1* | 2/2010 | Lee | F25C 1/24 62/344 |
| 2010/0251747 | A1 | 10/2010 | Lee | |
| 2011/0239686 | A1* | 10/2011 | Zhang | F25C 1/04 62/340 |

FOREIGN PATENT DOCUMENTS

| | | | |
|---|---|---|---|
| EP | 2320170 | A1 | 5/2011 |
| WO | 2008/023911 | A1 | 2/2008 |
| WO | 2008023899 | A1 | 2/2008 |
| WO | 2008026843 | A1 | 3/2008 |

OTHER PUBLICATIONS

International search report and written opinion, dated Sep. 28, 2015, of corresponding International Application No. PCT/EP2015/061850; 8 pgs.

* cited by examiner

*Primary Examiner* — Emmanuel Duke
(74) *Attorney, Agent, or Firm* — Kilpatrick Townsend & Stockton LLP

(57) ABSTRACT

The present invention relates to a refrigerator comprising an ice making unit wherein ice cubes are formed and that has an ice cube tray that is moved by being rotated, a body whereon the ice cube tray is located and that encloses the ice cube tray and more than one sealing member that extends between the side walls of the body and the ice cube tray.

9 Claims, 5 Drawing Sheets

REFRIGERATOR COMPRISING AN ICE MAKING UNIT

RELATED APPLICATIONS

Figure 1:
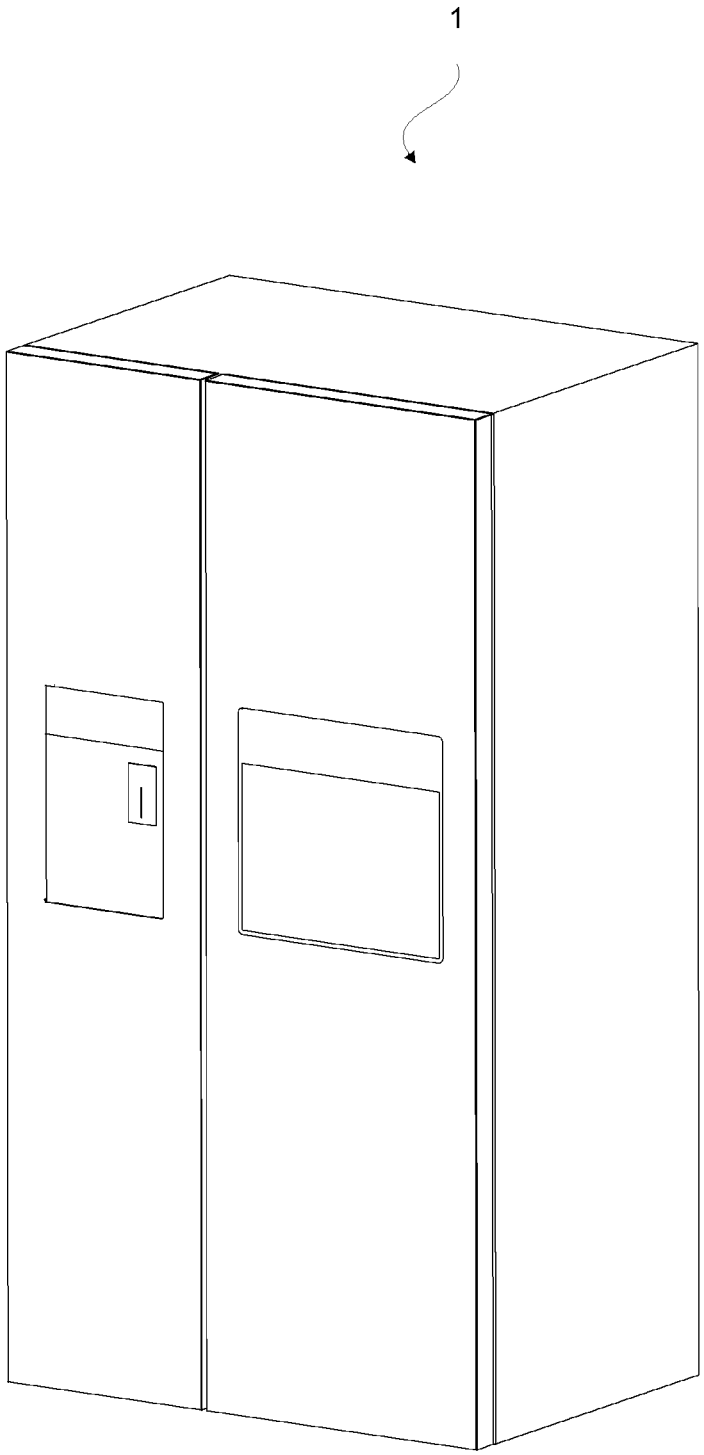

This application is a U.S. National Phase of International Application No. PCT/EP2015/061850, filed May 28, 2015, claiming priority to Turkish Patent Application No. 2014/08994, filed Aug. 1, 2014, contents of which are hereby incorporated by reference in their entirety.

The present invention relates to a refrigerator comprising an ice making unit.

In refrigerators, the ice making process is a process of taking the water required for making ice from a source, pouring the water into the ice cube tray, and creating ice by benefiting from the heat transfer in the freezing compartment; thus enabling the user to receive the amount of ice cubes he/she wants at any desired time. The ice cube trays which are a part of the ice making process are generally located in the freezing compartments of the refrigerators. In order to efficiently use the space in the freezing compartment, it is preferred to place the ice cube trays onto the freezing compartment door. However, opening/closing of the freezing compartment door during formation of ice may cause the not-yet frozen water to overflow from the ice cube tray or to splatter into the freezing compartment. The use of covers or sealing elements like gaskets over the cover or the ice cube tray in order to prevent overflowing and splattering of water from the ice cube tray is known.

In the state of the art International Patent Application No. WO2008023911, a sealing element that is folded to the rear side of the ice tray when the ice tray is rotated is disclosed.

The aim of the present invention is the realization of a refrigerator comprising an ice making unit wherein the water to be frozen is prevented from overflowing from the ice cube tray.

The refrigerator realized in order to attain the aim of the present invention, explicated in the first claim and the respective claims thereof, comprises an ice making unit that has an ice cube tray, a body whereon the ice cube tray is disposed, a flexible sealing member that is disposed on the ice cube tray and that moves together with the ice cube tray. The sealing member prevents water that has splattered from the ice cube tray due to any shaking or vibration from leaking out of the ice cube tray by forming a barrier in front of the water at its exit from the ice cube tray.

The sealing member of the present invention extends between the ice cube tray and the side walls of the body such that one end thereof is fixed on the body and the other end rests against the ice cube tray. As the ice cube tray is rotated, the end of the sealing member resting against the ice cube tray moves and detaches from the ice cube tray. The sealing member detached from the ice cube tray is held on the body by its end fixed on the side walls of the body. Thus, the movement of the sealing member is limited and prevented from deforming due to bending.

In an embodiment of the present invention, the ice making unit comprises a channel disposed on the body, into which the sealing member extends. The channel compresses the sealing member on the side wall of the body and fixes the sealing member on the body.

In an embodiment of the present invention, the ice making unit comprises more than one supporting plate that is surrounded by the body at least partially and whereon the sealing members disposed on opposite sides of the ice cube tray are hung. The sealing member is fastened to the body by means of the supporting plate. When the ice cube tray is rotated during the process of taking ice cubes, the flexible sealing member fastened to the fixed body can move on the ice cube tray without folding. Thus, the sealing member is prevented from deforming.

In an embodiment of the present invention, the sealing member extends between the ice cube tray and the side walls of the body in a manner inclined towards the ice cube tray. Due to the inclined configuration of the sealing member, when the water inside the ice cube tray splatters onto the sealing member it flows back into ice cube tray.

In an embodiment of the present invention, one of the sealing members disposed on opposite sides of the ice cube tray rests against the inner surface of the ice cube tray while the other rests against the outer surface of the ice cube tray. The ice cube tray can rotate during the process of taking ice cubes without its movement being limited since the sealing members are placed on the ice cube tray in a staggered manner.

A refrigerator realized in order to attain the aim of the present invention is illustrated in the attached claims, where:

FIG. 1—is the schematic view of a refrigerator.

Figure 2:
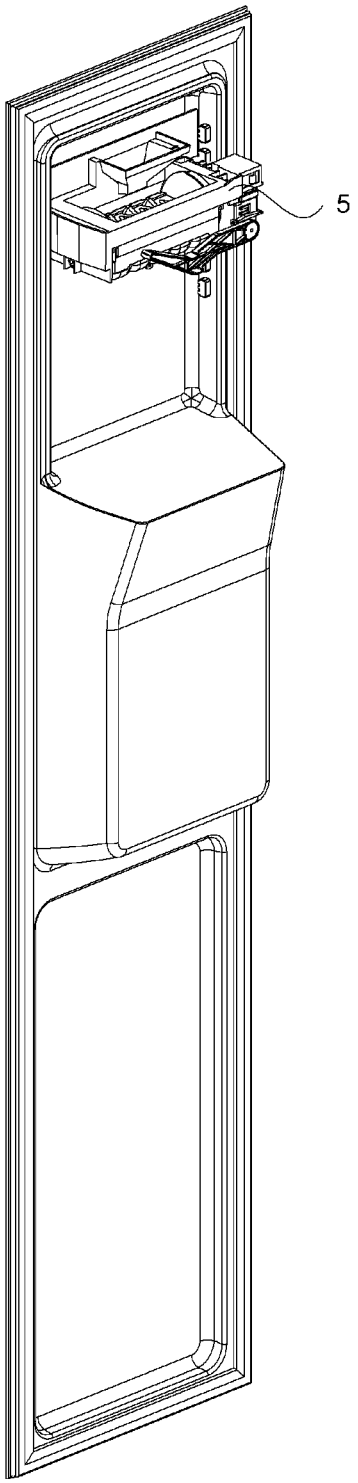

FIG. 2—is the schematic view of an ice making unit on the door of a refrigerator.

Figure 3:
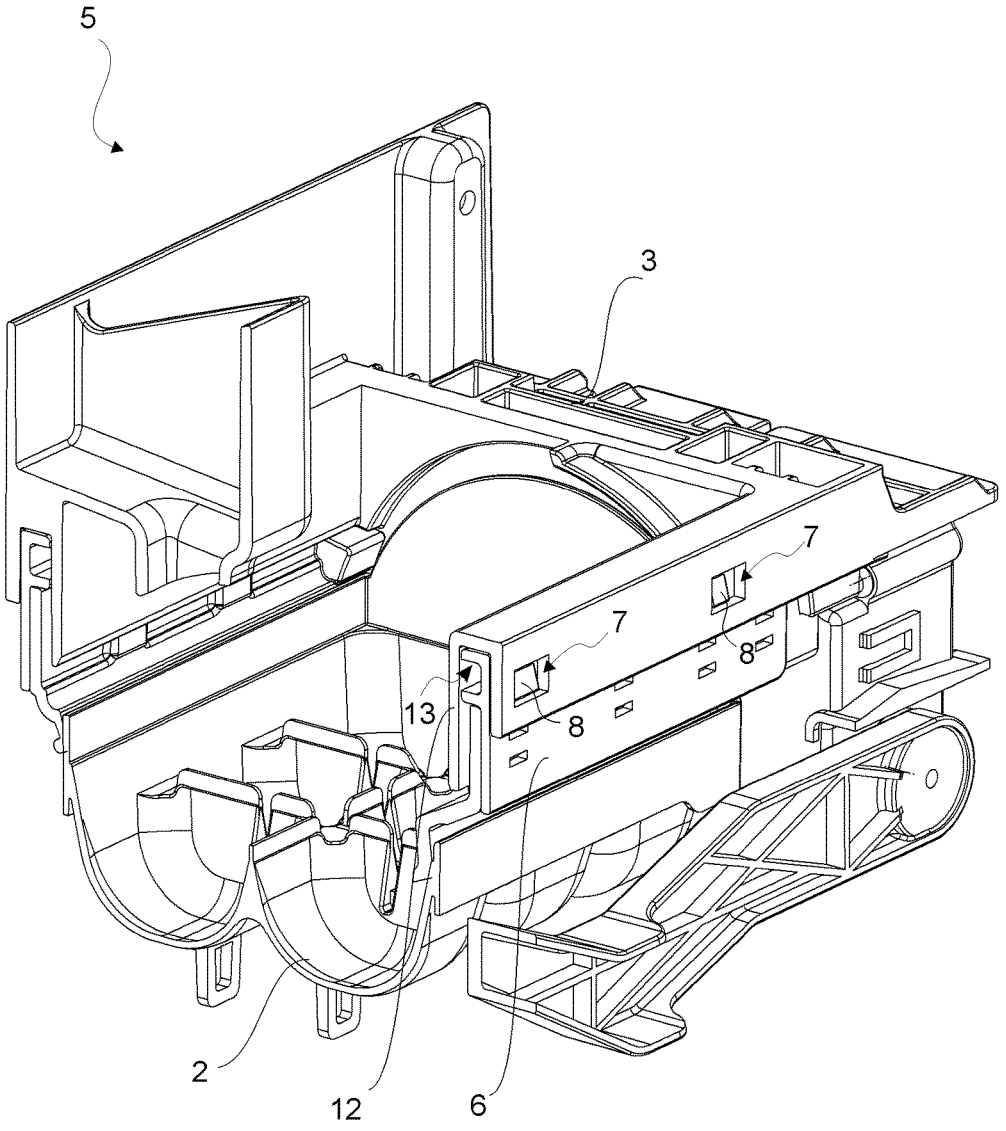

FIG. 3—is the partial perspective view of an ice making unit.

Figure 4:
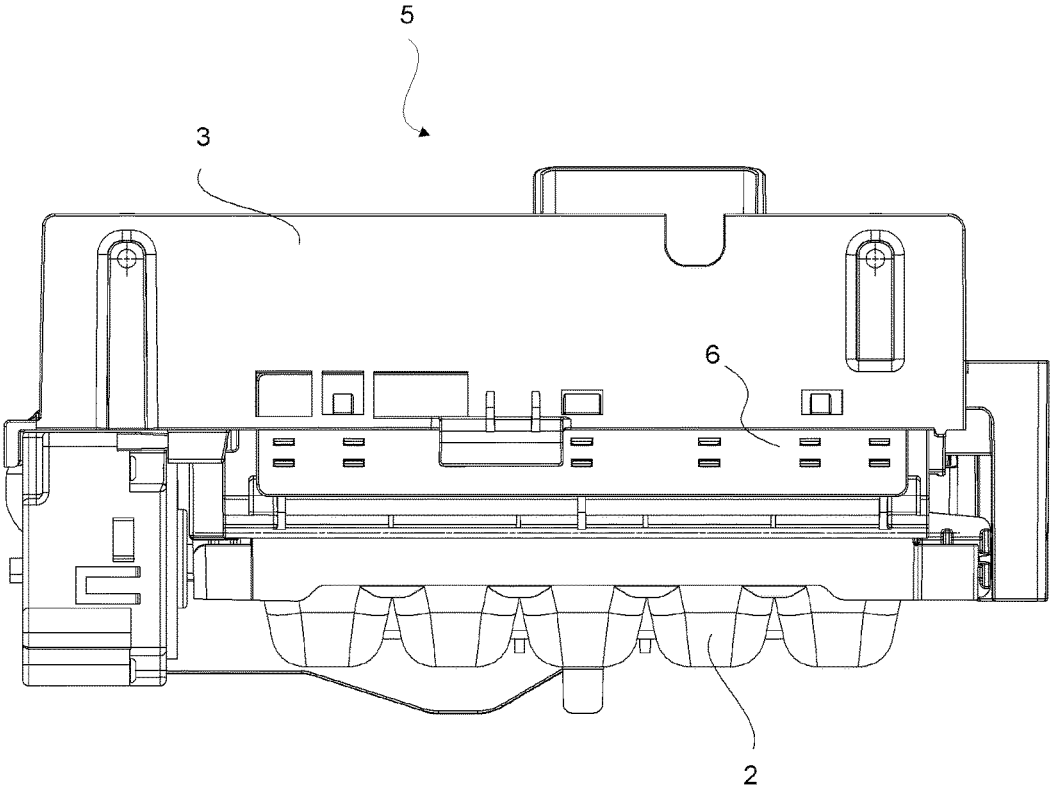

FIG. 4—is the cross-sectional view of an ice making unit.

Figure 5:
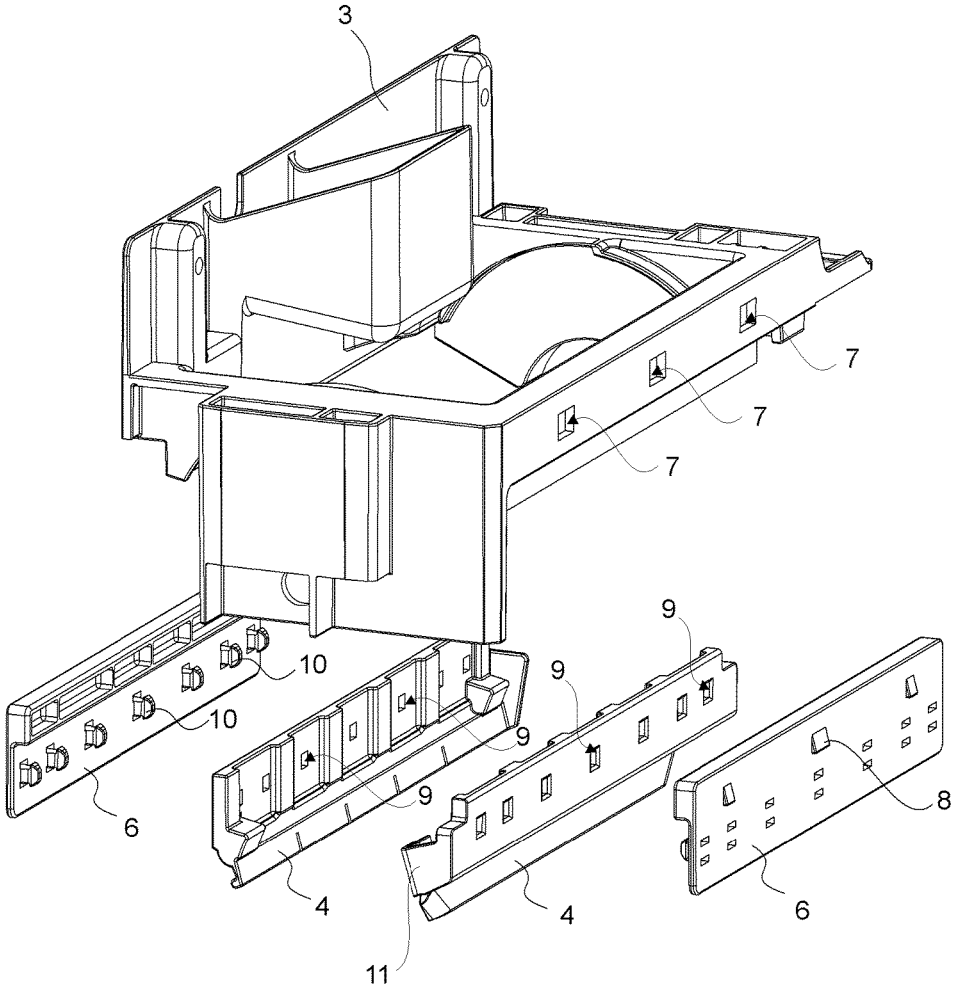

FIG. 5—is the perspective view of a body, a supporting plate and a sealing member.

The elements illustrated in the figures are numbered as follows:

1. Refrigerator
2. Ice cube tray
3. Body
4. Sealing member
5. Ice making unit
6. Supporting plate
7. Cut-out
8. Claw
9. Hole
10. Extension
11. Bend
12. Skirt
13. Channel The refrigerator (1) comprises an ice making unit (5) wherein ice cubes are formed and that has an ice cube tray (2) that is moved by being rotated, a body (3) whereon the ice cube tray (2) is located and that encloses the ice cube tray (2) and more than one sealing member (4) that extends between the side walls of the body (3) and the ice cube tray (2). The sealing member (4) prevents the water from overflowing from the ice cube tray (2) and splattering outside from the ice cube tray (2). One end of the sealing member (4) of the present invention is fixed on the body (3) while the other end rests against the ice cube tray (2). The sealing member (4), that extends between the side walls of the body (3) and the ice cube tray (2), prevents water from leaking out by isolating the gap between the side walls of the body (3) and the ice cube tray (2) from the outside environment. By means of fixing the sealing member (4) on the side walls of the body (3), during the rotational movement of the ice cube tray (2), the flexible sealing member (4) fixed on the fixed body (3) is enabled to be separated from the ice cube tray (2) controllably. Thus, the movement of the sealing member (4) is limited and the sealing member (4) is prevented from folding.

In an embodiment of the present invention, the ice making unit (5) comprises a channel (13) that is disposed on the body (3) so as to remain above the ice cube tray (2) and the end of the sealing member (4) fixed on the body (3) is placed into the channel (13). The channel (13) compresses the sealing member (4) on the side wall of the body (3) and facilitates the fixing of the sealing member (4) on the body (3). The channel (13) preferably extends along the side wall of the body (3).

In an embodiment of the present invention, the ice making unit (5) comprises at least one supporting plate (6) that is mounted to the body (3) so as to remain at least partially in the channel (13), whereon the sealing member (4) is mounted. The supporting plate (6) grasps the sealing member (4) when the ice cube tray (2) starts the rotational movement during the ice cube retrieving process and prevents the sealing member (4) from folding over the ice cube tray (2). Thus, friction-induced form changes in the sealing member (4) are prevented and the usage life of the sealing member (4) is increased.

In an embodiment of the present invention, the sealing member (4) extends between the ice cube tray (2) and the side walls of the body (3) in an inclined manner. Extending between the ice cube tray (2) and the side walls of the body (3) that are positioned on different vertical axis such that a gap remains therebetween, the sealing member (4) is inclined towards the ice cube tray (2). By means of the inclined configuration of the sealing member (4), splattering of the water inside the ice cube tray (2) onto the body (3) is made difficult. The inclined configuration furthermore facilitates the separation of the sealing member (4) from the ice cube tray (2) during the rotation of the ice cube tray (2).

In an embodiment of the present invention, one of the oppositely positioned sealing members (4) rests against the inner surface of the ice cube tray (2), the other against the outer surface of the ice cube tray (2). When the ice cube tray (2) is rotated, the sealing members (4) disposed on opposite sides of the ice cube tray (2) pull away and separate from the ice cube tray (2) by themselves. When the ice cube tray (2) is brought to its position before rotation, the sealing member (4) disposed at the front side of the ice cube tray (2) engages with the ice cube tray (2) to contact the inner surface of the ice cube tray (2) and the sealing member (4) disposed at the rear side to contact the outer surface of the ice cube tray (2). Thus, the sealing member (4) leaves the ice cube tray (2) without folding and getting deformed during the movement of the ice cube tray (2) and engages again with the ice cube tray (2) when the movement is completed.

In an embodiment of the present invention, the ice making unit (5) comprises at least one cut-out (7) disposed on the body (3) and at least one claw (8) that is disposed on the supporting plate (6) and that enables the supporting plate (6) to be mounted on the body (3) by resting against the surface of the cut-out (7).

In an embodiment of the present invention, the ice making unit (5) comprises at least one hole (9) arranged on the sealing member (4) and at least one extension (10) that enables the sealing member (4) to be suspended from the supporting plate (6) by engaging with the holes (9) arranged on the supporting plate (6).

In an embodiment of the present invention, the ice making unit (5) comprises a skirt (12) that extends from the channel (13) towards the sealing member (4) so as to at least partially cover at least one surface of the supporting plate (6). Water that splatters out from the ice cube tray (2) fills into the narrow gap formed by the skirt (12) and the sealing member (4) and flows back into the ice cube tray (2). The skirt (12) furthermore guides the movement of the sealing member (4) and prevents the sealing member (4) from folding during movement of the ice cube tray (2).

In an embodiment of the present invention, the ice making unit (5) comprises a bend (11) that is disposed on the sealing member (4) and that partially surrounds the corner of the body (3) by extending over the body (3). Thus, the sealing member (4) can be mounted on the ice cube tray (2) so as to isolate the corners of the ice cube tray (2) as well.

In an embodiment of the present invention, the bend (11) extends on the sealing member (4) so as to form an L shape with the sealing member (4).

By means of the present invention, the sealing element (4), that prevents water from overflowing from the ice cube tray (2) due to any shaking or vibration, is prevented from folding on the ice cube tray (2) while the ice cube tray (2) is rotated during the process of retrieving ice cubes and thus, the ice making process is enabled to be performed safely by prolonging the lifespan of the sealing element (4).

The invention claimed is:

1. A refrigerator comprising:

an ice making unit wherein ice cubes are formed, an ice cube tray that is moved by being rotated, a body whereon the ice cube tray is located and that encloses the ice cube tray and a sealing member that extends between the side walls of the body and the ice cube tray, wherein the sealing member has one end fixed on the body and another end that rests against the ice cube tray, and a channel disposed on the body so as to remain above the ice cube tray and by the sealing member, wherein the end of the sealing member fixed on the body is placed into the channel.

2. The refrigerator as in claim 1, wherein the ice making unit comprises at least one supporting plate that is mounted to the body so as to remain at least partially in the channel and whereon the sealing member is mounted.

3. The refrigerator as in claim 2, wherein the ice making unit comprises at least one cut-out that is arranged on the body and at least one claw that disposed on the supporting plate and that enables the supporting plate to be mounted on the body by resting against the surface of the cut-out.

4. The refrigerator as in claim 2, wherein the ice making unit comprises at least one hole arranged on the sealing member and at least one extension that enables the sealing member to be suspended from the supporting plate by engaging with the holes arranged on the supporting plate.

5. The refrigerator as in claim 2, wherein the ice making unit comprises a skirt that extends from the channel towards the sealing member so as to at least partially cover at least one surface of the supporting plate.

6. The refrigerator as in claim 1, wherein the sealing member extends between the ice cube tray and the side walls of the body in an inclined manner.

7. The refrigerator as in claim 1, wherein the ice making unit comprises two sealing members that are disposed oppositely, one resting against the inner surface of the ice cube tray and the other against the outer surface of the ice cube tray.

8. The refrigerator as in claim 1, wherein the ice making unit comprises a bend that is disposed on the sealing member and that partially surrounds the corner of the body by extending over the body.

9. The refrigerator as in claim 8, wherein the bend extends on the sealing member so as to form an L shape with the sealing member.

* * * * *